US009150808B2

(12) United States Patent
Krull et al.

(10) Patent No.: US 9,150,808 B2
(45) **Date of Patent: *Oct. 6, 2015**

(54) MULTIFUNCTIONAL COOLING ADDITIVES FOR MIDDLE DISTILLATES, HAVING AN IMPROVED FLOW CAPABILITY

(75) Inventors: Matthias Krull, Harxheim (DE); Werner Reimann, Frankfurt (DE); Stefan Dilsky, Gerbrunn (DE); Sabine Goetzke, Liederbach (DE)

(73) Assignee: Clariant Finance (BVI) Limited, Tortola (VG)

( * ) Notice: Subject to any disclaimer, the term of this patent is extended or adjusted under 35 U.S.C. 154(b) by 71 days.

This patent is subject to a terminal disclaimer.

(21) Appl. No.: 13/515,364

(22) PCT Filed: Dec. 7, 2010

(86) PCT No.: PCT/EP2010/007406

§ 371 (c)(1), (2), (4) Date: Aug. 14, 2012

(87) PCT Pub. No.: WO2011/076337

PCT Pub. Date: Jun. 30, 2011

(65) Prior Publication Data

US 2012/0304532 A1 Dec. 6, 2012

(30) Foreign Application Priority Data

Dec. 24, 2009 (DE) ..... 10 2009 060 389

(51) Int. Cl.

| | |
|---|---|
| ***C10L 1/18*** | (2006.01) |
| ***C10L 1/192*** | (2006.01) |
| ***C10L 1/195*** | (2006.01) |
| ***C10L 1/185*** | (2006.01) |
| ***C10L 1/14*** | (2006.01) |
| ***C10L 10/14*** | (2006.01) |
| ***C10L 10/16*** | (2006.01) |
| *C10L 1/16* | (2006.01) |
| *C10L 1/196* | (2006.01) |
| *C10L 1/197* | (2006.01) |
| *C10L 1/198* | (2006.01) |
| *C10L 1/224* | (2006.01) |

(52) U.S. Cl.

CPC ..... *C10L 1/143* (2013.01); *C10L 10/14* (2013.01); *C10L 10/16* (2013.01); *C10L 1/1608* (2013.01); *C10L 1/1616* (2013.01); *C10L 1/1641* (2013.01); *C10L 1/1963* (2013.01); *C10L 1/1973* (2013.01); *C10L 1/1981* (2013.01); *C10L 1/1983* (2013.01); *C10L 1/1985* (2013.01); *C10L 1/224* (2013.01)

(58) Field of Classification Search

CPC ..... C10L 1/1955; C10L 1/96; C10L 1/1966; C10L 1/224; C10L 1/1915; C10L 1/1989; C10L 1/19; C10L 19/196; C08F 218/04

USPC ..... 44/385, 398

See application file for complete search history.

(56) References Cited

U.S. PATENT DOCUMENTS

| | | | | |
|---|---|---|---|---|
| 2,993,773 | A * | 7/1961 | Stromberg | 60/209 |
| 3,048,479 | A | 8/1962 | Ilnyckyj et al. | |
| 3,447,916 | A | 6/1969 | Edwards | |
| 3,966,428 | A | 6/1976 | Rossi | |

(Continued)

FOREIGN PATENT DOCUMENTS

| | | |
|---|---|---|
| CA | 1244596 | 11/1988 |
| CA | 2017126 | 11/1990 |

(Continued)

OTHER PUBLICATIONS

International Search Report for PCT/EP2010/007406, Mail dated Jun. 16, 2011.

(Continued)

*Primary Examiner* — Pamela H Weiss
(74) *Attorney, Agent, or Firm* — Tod A. Waldrop

(57) ABSTRACT

The present invention relates to cooling additives for middle distillates, containing A) at least one polyester of formula (A1) wherein one of the radicals $R^1$ to $R^4$ represents a linear $C_{16}$-$C_{40}$ alkyl or alkenyl radical and the remainder of the radicals $R^1$ to $R^4$ represent, independently of one another, hydrogen or an alkyl radical having 1 to 3 C atoms, $R^5$ is a C—C bond or an alkylene radical having 1 to 6 C atoms, $R^{16}$ is a hydrocarbon group having 2 to 10 carbon atoms, n is an integer from 1 to 100, m is an integer from 3 to 250, p is 0 or 1, and q is 0 or 1, B) at least one copolymer of ethylene and of at least one ethylenically unsaturated ester, the copolymer having a melt viscosity, measured at 140 DEG C., of at most 5000 mPas, and C) at least one organic solvent.

A1

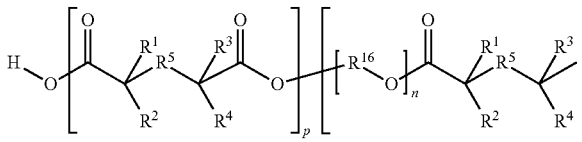

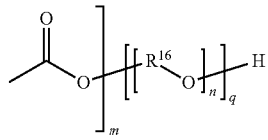

13 Claims, No Drawings

(56) References Cited

U.S. PATENT DOCUMENTS

| | | | | |
|---|---|---|---|---|
| 4,211,534 | A | 7/1980 | Feldman | |
| 5,186,720 | A | 2/1993 | Feustel et al. | |
| 5,266,084 | A | 11/1993 | Baillargeon et al. | |
| 5,391,632 | A | 2/1995 | Krull et al. | |
| 5,766,273 | A | 6/1998 | Dralle-Voss et al. | |
| 6,156,082 | A * | 12/2000 | MacMillan et al. | 44/398 |
| 6,475,250 | B2 * | 11/2002 | Krull et al. | 44/383 |
| 2006/0207166 | A1 * | 9/2006 | Herskowitz et al. | 44/385 |
| 2008/0236030 | A1 * | 10/2008 | Roberts et al. | 44/389 |
| 2008/0295397 | A1 | 12/2008 | Muth | |

FOREIGN PATENT DOCUMENTS

| | | |
|---|---|---|
| DE | 1147799 | 4/1963 |
| DE | 1920849 | 9/1970 |
| DE | 2451047 | 5/1975 |
| DE | 10349859 | 6/2005 |
| EP | 0154177 | 9/1985 |
| EP | 0398101 | 11/1990 |
| EP | 0413279 | 2/1991 |
| EP | 0606055 | 7/1994 |
| EP | 0777712 | 3/1996 |
| GB | 1215214 | 12/1970 |
| GB | 1346108 A * | 2/1974 |
| WO | WO 96/06902 | 3/1996 |
| WO | WO 2007/015080 | 2/2007 |

OTHER PUBLICATIONS

International Search Report for PCT/EP2010/007407, Mail dated Jun. 16, 2011.

English Abstract for DE 103 49 859, Jun. 16, 2005.

* cited by examiner

MULTIFUNCTIONAL COOLING ADDITIVES FOR MIDDLE DISTILLATES, HAVING AN IMPROVED FLOW CAPABILITY

The present invention relates to cold additives for middle distillates which have improved manageability at low temperatures, the use thereof for improvement of the cold properties of middle distillates, and the corresponding middle distillates.

In view of decreasing global oil reserves, ever heavier and hence paraffin-richer crude oils are being extracted and processed, which consequently also lead to paraffin-richer fuel oils. The paraffins present in crude oils and middle distillates in particular, such as gas oil, diesel and heating oil, can crystallize out as the temperature of the oil is lowered and agglomerate with intercalation of oil. This crystallization and agglomeration can result, in winter in particular, in blockages of the filters in engines and boilers, which prevent reliable dosage of the fuels and, under some circumstances, can cause complete interruption of the motor fuel or boiler fuel supply. Typically, even 0.1 to 0.3% by weight of crystallized paraffins in the oil are sufficient to block the fuel filter. The paraffin problem is additionally aggravated by the hydrogenating desulfurization of fuel oils, which has to be undertaken for environmental protection reasons for the purpose of lowering the sulfur content, and leads to an increased proportion of cold-critical paraffins and to a reduced proportion of mono- and polycyclic aromatics, which improve the solubility of paraffins, in the fuel oil.

The cold flow properties of middle distillates are often improved by adding chemical additives known as cold flow improvers or flow improvers, which modify the crystal structure and agglomeration tendency of the paraffins which precipitate out such that the oils thus additized can still be pumped and used at temperatures which are often more than 20° C. lower than in the case of unadditized oils. The cold flow improvers used are typically oil-soluble copolymers of ethylene and unsaturated esters.

For example, according to DE-A-11 47 799 oil-soluble copolymers of ethylene and vinyl acetate having a molecular weight between about 1000 and 3000 are added to mineral oil distillate fuels having a boiling range between about 120 and 400° C. Preference is given to copolymers containing about 60 to 99% by weight of ethylene and about 1 to 40% by weight of vinyl acetate.

For the additization of middle distillates having a high content of longer-chain paraffins in particular, these copolymers of ethylene and unsaturated esters are often used together with comb polymers. Comb polymers are understood to mean a specific form of the branched macromolecules, which bear comparatively long alkyl side chains of more or less equal length at more or less regular intervals on a linear main chain. Often, in the case of combined use of copolymers of ethylene and unsaturated esters with comb polymers, synergistically enhanced efficacies as cold additives are reported, and these are probably based on a nucleating function of these comb polymers on paraffin crystallization. These occur especially in the case of use of comb polymers with very long side chains.

U.S. Pat. No. 3,447,916 discloses condensation polymers formed from alkenylsuccinic anhydrides, polyols and fatty acids for lowering of the pour point of hydrocarbon oils. These polymers have a high side chain density due to the substantially complete esterification of the hydroxyl groups of the polyol. The document does not give any indications of combined use with further additives.

DE-A-19 20 849 discloses condensation polymers of alkenylsuccinic anhydrides, polyols having at least 4 OH groups and fatty acids for lowering of the pour point of hydrocarbon oils. The stoichiometry of the reactants used for the condensation is preferably selected such that the number of moles of OH groups and carboxyl groups is the same, i.e. there is essentially complete esterification. As a result of the use of polyhydric alcohols and the associated further increase in the side chain density, these polymers, according to the information in the disclosure, have an efficacy superior to the additives of U.S. Pat. No. 3,447,916. This document does not give any indications of combined use with further additives either.

DE-A-24 51 047 discloses light, low-viscosity distillate fuel oils which do not comprise any residues and have been additized with ethylene copolymers and comb polymers having $C_{18}$-$C_{44}$ side chains. The comb polymers used include ester condensation polymers of alk(en)ylsuccinic anhydride with a $C_{16}$-$C_{44}$-alk(en)yl radical, a polyol having 2-6 OH groups and a $C_{20}$-$C_{44}$-monocarboxylic acid. The three components of the polyester are preferably condensed in equimolar amounts, so as to result in essentially complete esterification of OH and also COOH groups. Demonstrated by way of example (polymer G) is a polycondensate of equimolar amounts of $C_{22-28}$-alkenylsuccinic anhydride, trimethylolpropane and $C_{20-22}$ fatty acids.

However, the use of polyols having more than two OH groups leads, in the polycondensation, typically to proportions of branched, high molecular weight and in some cases even crosslinked structures which impair the solubility of the additives and the filterability of the oils additized therewith. Suitable reaction control in the preparation of the esters can counteract this problem only incompletely.

Additive combinations of copolymers of ethylene and unsaturated esters and comb polymers, said combinations being used for the improvement of the cold properties of middle distillates, are typically used as concentrates in organic solvents in order to improve the manageability thereof. In this context, it is important particularly for the use of such additive concentrates at isolated sites, where there is often no means of heating the additive concentrates, that they remain free-flowing and miscible into fuel oils which are likewise cold at minimum temperature. At the same time, however, the active ingredient concentration in the concentrates should be at a maximum in order to minimize the volume of the additive concentrates to be transported and stored.

The prior art comb polymers prepared by polycondensation exhibit, as concentrates in organic solvents, and also in a blend with copolymers of ethylene and unsaturated esters in organic solvents, often comparatively high intrinsic pour points of more than 20° C. in some cases. At filling stations, and also in isolated areas, for example in the mountains or in Arctic regions, however, heated storage of the additive concentrates is often impossible. Dilution of the additives is undesirable for logistical reasons since the volumes to be transported and stored then increase significantly. In addition, especially the comb polymers derived from polyols having 3 or more OH groups often contain higher molecular weight fractions which impair the filterability of additized middle distillates.

Consequently, there is a need for highly effective cold additives for middle distillates, said cold additives being highly active and also manageable without problem at low ambient temperatures, and improving the cold flow properties of the middle distillates with minimum dosages. These additives shall also be free-flowing at low temperatures and be readily soluble in the middle distillate to be additized. In addition, they shall not impair the filterability of the additized middle distillates, or at least do so to a minimum degree.

It has been found that, surprisingly, additive combinations which comprise solutions or dispersions of copolymers of ethylene and unsaturated esters, and polyesters prepared by polycondensation of dicarboxylic acids or dicarboxylic anhydrides bearing linear $C_{16}$-$C_{40}$-alkyl radicals or $C_{16}$-$C_{40}$-alkenyl radicals, and diols, in organic solvents are free-flowing in concentrated form and have good solubility in middle distillates even at low temperatures of below 10° C., often below 0° C., in some cases below −10° C., for example at −20° C. or lower. In addition, they have excellent properties as cold flow improvers without impairing the filterability of the oils additized therewith. The efficacy as cold flow improvers is often improved over the prior art comb polymers, which is obviously attributable to the lower density of side chains and a resulting improvement in interaction with the paraffins which crystallize out of the oil.

The invention provides cold additives for middle distillates comprising

A) at least one polyester of the formula

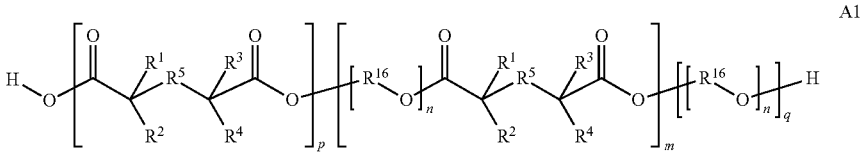

A1 in which one of the $R^1$ to $R^4$ radicals is a linear $C_{16}$-$C_{40}$-alkyl or -alkenyl radical and the rest of the $R^1$ to $R^4$ radicals are each independently hydrogen or an alkyl radical having 1 to 3 carbon atoms, $R^5$ is a C—C bond or an alkylene radical having 1 to 6 carbon atoms, $R^{16}$ is a hydrocarbyl group having 2 to 10 carbon atoms, n is a number from 1 to 100, m is a number from 3 to 250, p is 0 or 1, and q is 0 or 1, B) at least one copolymer of ethylene and at least one ethylenically unsaturated ester, said copolymer having a melt viscosity measured at 140° C. of not more than 5000 mPas and C) at least one organic solvent.

The invention further provides a process for improving the cold flow properties of fuel oils, by adding to a middle distillate a cold additive which comprises A) at least one polyester of the formula

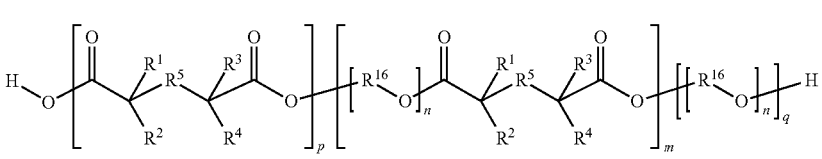

A1 in which one of the $R^1$ to $R^4$ radicals is a linear $C_{16}$-$C_{40}$-alkyl or -alkenyl radical and the rest of the $R^1$ to $R^4$ radicals are each independently hydrogen or an alkyl radical having 1 to 3 carbon atoms, $R^5$ is a C—C bond or an alkylene radical having 1 to 6 carbon atoms, $R^{16}$ is a hydrocarbyl group having 2 to 10 carbon atoms, n is a number from 1 to 100, m is a number from 3 to 250, p is 0 or 1, and q is 0 or 1, B) at least one copolymer of ethylene and at least one ethylenically unsaturated ester, said copolymer having a melt viscosity measured at 140° C. of not more than 5000 mPas and C) at least one organic solvent.

The invention further provides fuel oils comprising a middle distillate and a cold additive which comprises A) at least one polyester of the formula

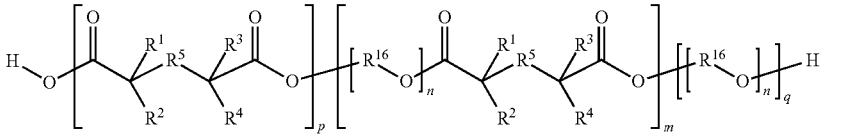

A1 in which one of the $R^1$ to $R^4$ radicals is a linear $C_{16}$-$C_{40}$-alkyl or -alkenyl radical and the rest of the $R^1$ to $R^4$ radicals are each independently hydrogen or an alkyl radical having 1 to 3 carbon atoms, $R^5$ is a C—C bond or an alkylene radical having 1 to 6 carbon atoms, $R^{16}$ is a hydrocarbyl group having 2 to 10 carbon atoms, n is a number from 1 to 100, m is a number from 3 to 250, p is 0 or 1, and q is 0 or 1, B) at least one copolymer of ethylene and at least one ethylenically unsaturated ester, said copolymer having a melt viscosity measured at 140° C. of not more than 5000 mPas and C) at least one organic solvent.

Preferred dicarboxylic acids suitable for preparation of the polyesters A) correspond to the general formula 1

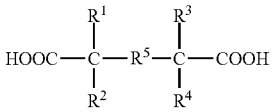

(1)

in which one of the $R^1$ to $R^4$ radicals is a linear $C_{16}$-$C_{40}$-alkyl or -alkenyl radical and the other $R^1$ to $R^4$ radicals are each independently hydrogen or an alkyl radical having 1 to 3 carbon atoms, and $R^5$ is a C—C bond or an alkylene radical having 1 to 6 carbon atoms.

More preferably, one of the $R^1$ to $R^4$ radicals is a linear $C_{16}$-$C_{40}$-alkyl or -alkenyl radical, also referred to collectively hereinafter as $C_{16}$-$C_{40}$-alk(en)yl radical, one is a methyl group and the rest are hydrogen. In a specific embodiment, one of the $R^1$ to $R^4$ radicals is a linear $C_{16}$-$C_{40}$-alkyl or -alkenyl radical and the others are hydrogen. In a particularly preferred embodiment, $R^5$ is a C—C single bond. More particularly, one of the $R^1$ to $R^4$ radicals is a linear $C_{16}$-$C_{40}$-alkyl or -alkenyl radical, the other $R^1$ to $R^4$ radicals are hydrogen and $R^5$ is a C—C single bond.

The dicarboxylic acids or anhydrides thereof bearing alkyl and/or alkenyl radicals can be prepared by known processes. For example, they can be prepared by heating ethylenically unsaturated dicarboxylic acids with olefins ("ene reaction") or with chloroalkanes. Preference is given to the thermal addition of olefins onto ethylenically unsaturated dicarboxylic acids, which is typically performed at temperatures between 100 and 250° C. The dicarboxylic acids and dicarboxylic anhydrides bearing alkenyl radicals formed can be hydrogenated to dicarboxylic acids and dicarboxylic anhydrides bearing alkyl radicals. Dicarboxylic acids and anhydrides thereof preferred for the reaction with olefins are maleic acid and more preferably maleic anhydride. Additionally suitable are itaconic acid, citraconic acid and the anhydrides thereof, and the esters of the aforementioned acids, especially with lower $C_1$-$C_8$-alcohols, for example methanol, ethanol, propanol and butanol.

For the preparation of the dicarboxylic acids or anhydrides thereof bearing alkyl radicals, preference is given to using linear olefins having 16 to 40 carbon atoms and especially having 18 to 36 carbon atoms, for example having 19 to 32 carbon atoms. In a particularly preferred embodiment, mixtures of olefins with different chain lengths are used. Preference is given to using mixtures of olefins and especially of α-olefins having 18 to 36 carbon atoms, for example mixtures in the $C_{20}$-$C_{22}$, $C_{20}$-$C_{24}$, $C_{24}$-$C_{28}$, $C_{26}$-$C_{28}$, $C_{30}$-$C_{36}$ range. These olefins may also contain minor amounts of shorter- and/or longer-chain olefins, but preferably not more than 10% by weight and especially not more than 0.1 to 5% by weight. Preferred olefins have a linear or at least substantially linear alkyl chain. "Linear or substantially linear" is understood to mean that at least 50% by weight, preferably 70 to 99% by weight, especially 75 to 95% by weight, for example 80 to 90% by weight, of the olefins have a linear component having 16 to 40 carbon atoms. Suitable olefins are preferably technical alkene mixtures. These contain preferably at least 50% by weight, more preferably 60 to 99% by weight and especially 70 to 95% by weight, for example 75 to 90% by weight, of terminal double bonds (α-olefins). In addition, they may contain up to 50% by weight, preferably 1 to 40% by weight and especially 5 to 30% by weight, for example 10 to 25% by weight, of olefins having an internal double bond, for example having vinylidene double bonds with the structural element $R^{17}$—CH═C$(CH_3)_2$, where $R^{17}$ is an alkyl radical having 12 to 36 carbon atoms and especially having 14 to 32 carbon atoms, for example having 15 to 28 carbon atoms. In addition, minor amounts of secondary components of technical origin, for example paraffins, may be present, but preferably not more than 5% by weight. Particular preference is given to olefin mixtures containing at least 75% by weight of linear α-olefins having a carbon chain length in the range from $C_{20}$ to $C_{24}$.

Preferred polyesters A) are preparable by reaction of alkyl- or alkenylsuccinic acids bearing a linear $C_{16}$-$C_{40}$-alkyl or -alkenyl radical and/or anhydrides thereof with diols.

In a first preferred embodiment n is 1. Preferred diols of this kind have 2 to 10 carbon atoms, more preferably 2 to 6 carbon atoms and especially 2 to 4 carbon atoms. They may be derived from aliphatic or aromatic hydrocarbons. The hydrocarbyl radicals preferably do not contain any further heteroatoms. The hydroxyl groups are on different carbon atoms of the hydrocarbyl radical. They are preferably on adjacent carbon atoms or on the terminal carbon atoms of an aliphatic hydrocarbyl radical or in the ortho and para position of an aromatic hydrocarbyl radical. Aliphatic hydrocarbyl radicals are preferred. The aliphatic hydrocarbyl radicals may be linear, branched or cyclic. Preferably, they are linear. Additionally preferably, they are saturated. Examples of preferred diols are ethylene glycol, 1,2-propanediol, 1,3-propanediol, 1,2-butanediol, 1,4-butanediol, 1,5-pentanediol, neopentyl glycol, 1,6-hexanediol and mixtures thereof. Particular preference is given to ethylene glycol.

In a second preferred embodiment, n is a number from 2 to 100, more preferably a number from 3 to 50 and especially a number from 4 to 20, for example a number from 5 to 15. In this embodiment, the diols are preferably oligomers and polymers of $C_2$-$C_4$-alkylene oxides and especially oligomers and polymers of ethylene oxide and/or propylene oxide. The degree of condensation of these oligomers and polymers is preferably between 2 and 100, more preferably between 3 and 50 and especially between 4 and 20, for example between 5 and 15. Examples of preferred oligomers and polymers of $C_2$-$C_4$-alkylene oxides are diethylene glycol, triethylene glycol, tetraethylene glycol, poly(ethylene glycol), poly(propylene glycol), poly(ethylene glycol-co-propylene glycol) and mixtures thereof.

The reaction of the dicarboxylic acids bearing alkyl radicals or the anhydrides thereof or esters thereof with the diol is effected preferably in a molar ratio of 1:2 to 2:1, more preferably in a molar ratio of 1:1.5 to 1.5:1, particularly in a molar ratio of 1:1.2 to 1.2:1 and especially in a molar ratio of 1:1.1 to 1.1:1, for example an equimolar ratio. Particular preference is given to effecting the reaction with a slight excess of diol. Particularly useful molar excesses have been found to be from 1 to 10 mol % and especially 1.5 to 5 mol %, based on the amount of dicarboxylic acid used. The condensation is effected preferably by heating $C_{16}$-$C_{40}$-alkyl or -alkenyl-substituted dicarboxylic acid or the anhydride or ester thereof with the diol to temperatures above 100° C. and preferably to temperatures between 120 and 320° C., for example to temperatures between 150 and 290° C.

To establish the molecular weight of the polyesters A), which is important for the efficacy, it is typically necessary to remove water or alcohol of reaction, which can be effected, for example, by distillative removal. Azeotropic removal by means of suitable organic solvents is also suitable for this purpose. To accelerate the polycondensation, it has often been found to be useful to add catalysts to the reaction mixture. Suitable catalysts are known acidic, basic and organometallic compounds.

The acid number of the polyesters A) is preferably less than 40 mg KOH/g and more preferably less than 30 mg KOH/g, for example less than 20 mg KOH/g. The acid number can be determined, for example, by titration of the polymer with alcoholic tetra-n-butylammonium hydroxide solution in xylene/isopropanol. Additionally preferably, the hydroxyl number of the polyesters A) is below 40 mg KOH/g, more preferably below 30 mg KOH/g and especially below 20 mg KOH/g. The hydroxyl number can be determined, after reaction of the free OH groups with isocyanate, by means of $^1$H NMR spectroscopy by quantitative determination of the urethane formed.

In a preferred embodiment, to establish the molecular weight, minor amounts of the dicarboxylic acids bearing alkyl radicals, anhydrides thereof or esters thereof are replaced in the reaction mixture by $C_1$- to $C_{30}$-monocarboxylic acids, more preferably $C_2$- to $C_{18}$-monocarboxylic acids, particularly $C_2$- to $C_{16}$-monocarboxylic acids and especially $C_3$- to $C_{14}$-monocarboxylic acids, for example $C_4$- to $C_{12}$-monocarboxylic acids, or esters thereof with lower alcohols. However, not more than 20 mol % and preferably 0.1 to 10 mol %, for example 0.5 to 5 mol %, of the dicarboxylic acids bearing alk(en)yl radicals or anhydrides thereof or esters thereof is replaced by a monocarboxylic acid or esters thereof. Mixtures of different carboxylic acids are also suitable therefor. After the polycondensation, the hydroxyl number of the polymer is preferably less than 10 mg KOH/g and especially less than 5 mg KOH/g, for example less than 2 mg KOH/g. Particular preference is given to preparing the polyesters A) in the absence of monocarboxylic acids. In addition, it is also possible to replace minor amounts, for example up to 10 mol % and especially 0.01 to 5 mol % of the dicarboxylic acids bearing alkyl radicals, anhydrides thereof or esters thereof, with further dicarboxylic acids, for example succinic acid, glutaric acid, maleic acid and/or fumaric acid.

In a further preferred embodiment, to establish the molecular weight, minor amounts of the diol in the reaction mixture are replaced by $C_1$- to $C_{30}$-monoalcohols, more preferably $C_2$- to $C_{24}$-monoalcohols and especially $C_3$- to $C_{18}$-monoalcohols, for example $C_4$- to $C_{12}$-monoalcohols. Mixtures of different alcohols are also suitable therefor. After the polycondensation, the acid number of the polymer is preferably less than 10 mg KOH/g and especially less than 5 mg KOH/g, for example less than 2 mg KOH/g. Preferably at most 20 mol % and more preferably 0.1 to 10 mol %, for example 0.5 to 5 mol %, of the polyol is replaced by one or more monoalcohols. Particular preference is given to preparing the polyesters A) in the absence of monoalcohols.

The mean degree of condensation m of the inventive polymers A1 is preferably between 4 and 200, more preferably between 5 and 150 and especially between 7 and 100, for example between 10 and 50. The weight-average molecular weight Mw of the polyesters A), determined by means of GPC against poly(ethylene glycol) standards, is preferably between 1500 and 100 000 g/mol and especially between 2500 and 50 000 g/mol, for example between 4000 and 20 000 g/mol. Preferred copolymers of ethylene and olefinically unsaturated esters B) are especially those which, as well as ethylene, contain 8 to 21 mol % and especially 10 to 19 mol % of olefinically unsaturated esters as comonomers.

The olefinically unsaturated esters are preferably vinyl esters, acrylic esters and/or methacrylic esters. It is possible for one or more esters to be present as comonomers in the polymer.

The vinyl esters are preferably those of the formula 2

$$CH_2{=}CH{-}OCOR^{12} \quad (2)$$

in which $R^{12}$ is $C_1$- to $C_{30}$-alkyl, preferably $C_1$- to $C_{16}$-alkyl, especially $C_1$- to $C_{12}$-alkyl. In a further embodiment, the alkyl groups mentioned may be substituted by one or more hydroxyl groups.

Particularly preferred vinyl esters derive from secondary and especially tertiary carboxylic acids whose branch is in the alpha-position to the carbonyl group. Preferably, $R^{12}$ in these vinyl esters is $C_4$- to $C_{16}$-alkyl and especially $C_6$- to $C_{12}$-alkyl. In a further preferred embodiment, $R^{12}$ is a branched alkyl radical or a neoalkyl radical having 7 to 11 carbon atoms, especially having 8, 9 or 10 carbon atoms. Suitable vinyl esters include vinyl acetate, vinyl propionate, vinyl butyrate, vinyl isobutyrate, vinyl hexanoate, vinyl heptanoate, vinyl octanoate, vinyl pivalate, vinyl 2-ethylhexanoate, vinyl laurate, vinyl stearate and Versatic esters such as vinyl neononanoate, vinyl neodecanoate, vinyl neoundecanoate.

In a further preferred embodiment, these ethylene copolymers contain vinyl acetate and at least one further vinyl ester of the formula 2 in which $R^{12}$ is $C_4$- to $C_{30}$-alkyl, preferably $C_4$- to $C_{16}$-alkyl, especially $C_6$- to $C_{12}$-alkyl. More preferably, the further vinyl esters are alpha-branched.

The acrylic and methacrylic esters, summarized hereinafter as (meth)acrylic esters, are preferably those of the formula 3

$$CH_2{=}CR^{13}{-}COOR^{14} \quad (3)$$

in which $R^{13}$ is hydrogen or methyl and $R^{14}$ is $C_1$- to $C_{30}$-alkyl, preferably $C_4$- to $C_{16}$-alkyl, especially $C_6$- to $C_{12}$-alkyl. Suitable acrylic esters include, for example, methyl(meth)acrylate, ethyl(meth)acrylate, propyl(meth)acrylate, n- and isobutyl(meth)acrylate, hexyl, octyl, 2-ethylhexyl, decyl, dodecyl, tetradecyl, hexadecyl, octadecyl(meth)acrylate and mixtures of these comonomers. In a further embodiment, the alkyl groups mentioned may be substituted by one or more hydroxyl groups. An example of such an acrylic ester is hydroxyethyl methacrylate.

The copolymers B) may, as well as olefinically unsaturated esters, also contain further olefinically unsaturated compounds as comonomers. Preferred comonomers of this kind are alkyl vinyl ethers and alkenes.

The alkyl vinyl ethers are preferably compounds of the formula 4

$$CH_2{=}CH{-}OR^{15} \quad (4)$$

in which $R^{15}$ is $C_1$- to $C_{30}$-alkyl, preferably $C_4$- to $C_{16}$-alkyl, especially $C_6$- to $C_{12}$-alkyl. Examples include methyl vinyl ether, ethyl vinyl ether, isobutyl vinyl ether. In a further embodiment, the alkyl groups mentioned may be substituted by one or more hydroxyl groups.

The alkenes are preferably monounsaturated hydrocarbons having 3 to 30 carbon atoms, especially 4 to 16 carbon atoms and especially 5 to 12 carbon atoms. Suitable alkenes include propene, butene, isobutylene, pentene, hexene, 4-methylpentene, octene, diisobutylene and norbornene and derivatives thereof such as methylnorbornene and vinylnorbornene. In a further embodiment, the alkyl groups mentioned may be substituted by one or more hydroxyl groups.

Apart from ethylene, particularly preferred terpolymers contain 3.5 to 20 mol %, especially 8 to 15 mol %, of vinyl acetate, and 0.1 to 12 mol %, especially 0.2 to 5 mol %, of at least one relatively long-chain and preferably branched vinyl ester, for example vinyl 2-ethylhexanoate, vinyl neononanoate or vinyl neodecanoate, the total comonomer content of the terpolymers being preferably between 8.1 and 21 mol %, especially between 8.2 and 19 mol %, for example between 12 and 18 mol %. Further particularly preferred copolymers contain, in addition to ethylene and 8 to 18 mol % of vinyl esters of $C_2$- to $C_{12}$-carboxylic acids, also 0.5 to 10 mol % of olefins such as propene, butene, isobutylene, hexene, 4-methylpentene, octene, diisobutylene and/or norbornene, the total comonomer content being preferably between 8.5 and 21 mol % and especially between 8.2 and 19 mol %.

These ethylene co- and terpolymers preferably have melt viscosities at 140° C. of 20 to 2500 mPas, particularly of 30 to 1000 mPas, especially of 50 to 500 mPas. The degrees of branching determined by means of $^1$H NMR spectroscopy are preferably between 1 and 9 $CH_3$/100 $CH_2$ groups, especially between 2 and 6 $CH_3$/100 $CH_2$ groups, which do not originate from the comonomers.

Preference is given to using mixtures of two or more of the abovementioned ethylene copolymers. More preferably, the polymers on which the mixtures are based differ in at least one characteristic. For example, they may contain different comonomers, or have different comonomer contents, molecular weights and/or degrees of branching. For example, mixtures of ethylene copolymers having different comonomer contents have been found to be particularly useful, the comonomer contents thereof differing by at least 2 mol % and especially more than 3 mol %.

The inventive cold additives contain preferably 25 to 95% by weight and preferably 28 to 80% by weight, for example 35 to 70% by weight, of at least one organic solvent C). Preferred solvents are relatively high-boiling, low-viscosity organic solvents. These solvents preferably contain only minor amounts of heteroatoms, and they especially consist only of hydrocarbons. Additionally preferably, the kinematic viscosity thereof, measured at 20° C., is below 10 $mm^2/s$ and especially below 6 $mm^2/s$.

Particularly preferred solvents are aliphatic and aromatic hydrocarbons and mixtures thereof. Aliphatic hydrocarbons preferred as solvents have 9 to 20 carbon atoms and especially 10 to 16 carbon atoms. They may be linear, branched and/or cyclic. They may also be saturated or unsaturated; they are preferably saturated or at least very substantially saturated. Aromatic hydrocarbons preferred as solvents have 7 to 20 carbon atoms and especially 8 to 16, for example 9 to 13, carbon atoms. Preferred aromatic hydrocarbons are mono-, di-, tri- and polycyclic aromatics. In a preferred embodiment, these bear one or more, for example two, three, four, five or more, substituents. In the case of a plurality of substituents, these may be the same or different. Preferred substituents are alkyl radicals having 1 to 20 and especially having 1 to 5 carbon atoms, for example methyl, ethyl, n-propyl, isopropyl, n-butyl, isobutyl, tert-butyl, n-pentyl, isopentyl, tert-pentyl and neopentyl radical. Examples of suitable aromatics are alkylbenzenes and alkylnaphthalenes. Particularly suitable examples are aliphatic and/or aromatic hydrocarbons or hydrocarbon mixtures, for example gasoline fractions, kerosene, decane, pentadecane, toluene, xylene, ethylbenzene, or commercial solvent mixtures such as Solvent Naphtha, Shellsoll® AB, Solvesso® 150, Solvesso® 200, Exxsol®, ISOPAR® and Shellsol® D products. The solvent mixtures specified contain different amounts of aliphatic and/or aromatic hydrocarbons. The solvent C) may optionally also contain polar solubilizers, for example alcohols, organic acids, ethers and/or esters of organic acids. Preferred solubilizers have 4 to 24 carbon atoms, more preferably 6 to 18 and especially 8 to 16 carbon atoms. Examples of suitable solubilizers are butanol, 2-ethylhexanol, decanol, isodecanol, isotridecanol, nonylphenol, benzoic acid, oleic acid, dihexyl ether, dioctyl ether, 2-ethylhexyl acid butyrate, ethyl octanoate, ethyl hexanoate, butyl 2-ethylhexanoate and 2-ethylhexyl butyrate, and higher ethers and/or higher esters, for example di(2-ethylhexyl)ether, 2-ethylhexyl 2-ethylhexanoate and 2-ethylhexyl stearate. The proportion of polar solubilizers in the solvent C) is preferably 5 to 80% by weight and especially 10 to 65% by weight. In addition to the solvents based on mineral oils, other suitable solvents C) are those based on renewable raw materials, for example biodiesel based on vegetable oils and the methyl esters derived therefrom, especially rapeseed oil methyl ester, and synthetic hydrocarbons obtainable, for example, from the Fischer-Tropsch process. Mixtures of the solvents mentioned are also suitable.

The inventive cold additives contain preferably 1.5 to 73.5%, particularly 15 to 70% and especially 25 to 60% by weight of constituent B).

The inventive cold additives contain preferably 0.1 to 50%, particularly 0.5 to 30% and especially 1 to 20% by weight of constituent A).

The inventive cold additives are added to middle distillates preferably in amounts of 0.001 to 1.0% by weight, more preferably 0.002 to 0.5% by weight, for example 0.005 to 0.2% by weight.

The inventive cold additives can be used together with one or more further cold flow improvers. They are preferably used together with one or more of cold flow improvers III) to VII):

Further suitable cold flow improvers are oil-soluble polar nitrogen compounds (constituent III). These are preferably reaction products of fatty amines with compounds which contain an acyl group. The preferred amines are compounds of the formula $NR^6R^7R^8$ in which $R^6$, $R^7$ and $R^8$ may be the same or different, and at least one of these groups is $C_8$-$C_{36}$-alkyl, $C_6$-$C_{36}$-cycloalkyl or $C_8$-$C_{36}$-alkenyl, especially $C_{12}$-$C_{24}$-alkyl, $C_{12}$-$C_{24}$-alkenyl or cyclohexyl, and the remaining groups are hydrogen, $C_1$-$C_{36}$-alkyl, $C_2$-$C_{36}$-alkenyl, cyclohexyl or a group of the formulae $-(A\text{-}O)_x\text{-}E$ or $—(CH_2)_k—NYZ$ in which A is an ethyl or propyl group, x is from 1 to 50, E=H, $C_1$-$C_{30}$-alkyl, $C_5$-$C_{12}$-cycloalkyl or $C_6$-$C_{30}$-aryl, and k=2, 3 or 4, and Y and Z are each independently H, $C_1$-$C_{30}$-alkyl or $-(A\text{-}O)_x$. The alkyl and alkenyl radicals may each be linear or branched and contain up to two double bonds. They are preferably linear and substantially saturated, i.e. they have iodine numbers of less than 75 g of $I_2$/g, preferably less than 60 g of $I_2$/g and especially between 1 and 10 g of $I_2$/g. Particular preference is given to secondary fatty amines in which two of the $R^6$, $R^7$ and $R^8$ groups are each $C_8$-$C_{36}$-alkyl, $C_6$-$C_{36}$-cycloalkyl, $C_8$-$C_{36}$-alkenyl, especially $C_{12}$-$C_{24}$-alkyl, $C_{12}$-$C_{24}$-alkenyl or cyclohexyl, and the third is hydrogen. Suitable fatty amines are, for example, octylamine, decylamine, dodecylamine, tetradecylamine, hexadecylamine, octadecylamine, eicosylamine, behenylamine, didecylamine, didodecylamine, ditetradecylamine, dihexadecylamine, dioctadecylamine, dieicosylamine, dibehenylamine and mixtures thereof. The amines especially contain chain cuts based on natural raw materials, for example coconut fatty amine, tallow fatty amine, hydrogenated tallow fatty amine, dicoconut fatty amine, ditallow fatty amine and di(hydrogenated tallow fatty amine). Particularly preferred amine derivatives are amine salts, imides and/or amides, for example amide-ammonium salts of secondary fatty amines, especially of dicoconut fatty amine, ditallow fatty amine and distearylamine.

Acyl group is understood here to mean a functional group of the following formula:

>C=O

Carbonyl compounds suitable for the reaction with amines are either monomeric or polymeric compounds having one or more carboxyl groups. Preference is given to those monomeric carbonyl compounds having 2, 3 or 4 carbonyl groups. They may also contain heteroatoms such as oxygen, sulfur and nitrogen. Suitable carboxylic acids are, for example, maleic acid, fumaric acid, crotonic acid, itaconic acid, succinic acid, $C_1$-$C_{40}$-alk(en)ylsuccinic acid, adipic acid, glutaric acid, sebacic acid and malonic acid, and also benzoic acid, phthalic acid, trimellitic acid and pyromellitic acid, nitrilotriacetic acid, ethylenediaminetetraacetic acid and their reactive derivatives, for example esters, anhydrides and acid halides. Useful polymeric carbonyl compounds have been found to be especially copolymers of ethylenically unsaturated acids, for example acrylic acid, methacrylic acid, maleic acid, fumaric acid and itaconic acid; particular preference is given to copolymers of maleic anhydride. Suitable comonomers are those which impart oil solubility to the copolymer. Oil-soluble means here that the copolymer, after reaction with the fatty amine, dissolves without residue in the middle distillate to be additized in practically relevant dosages. Suitable comonomers are, for example, olefins, alkyl esters of acrylic acid and methacrylic acid, alkyl vinyl esters and alkyl vinyl ethers each having 2 to 75, preferably 4 to 40 and especially 8 to 20 carbon atoms in the alkyl radical. In the case of olefins, the carbon number is based on the alkyl radical attached to the double bond. The molecular weights of the polymeric carbonyl compounds are preferably between 400 and 20 000, more preferably between 500 and 10 000, for example between 1000 and 5000.

It has been found that particularly useful oil-soluble polar nitrogen compounds are those which are obtained by reaction of aliphatic or aromatic amines, preferably long-chain aliphatic amines, with aliphatic or aromatic mono-, di-, tri- or tetracarboxylic acids or their anhydrides (cf. U.S. Pat. No. 4,211,534). Equally suitable as oil-soluble polar nitrogen compounds are amides and ammonium salts of aminoalkylenepolycarboxylic acids such as nitrilotriacetic acid or ethylenediaminetetraacetic acid with secondary amines (cf. EP-A-0 398 101). Other oil-soluble polar nitrogen compounds are copolymers of maleic anhydride and α,β-unsaturated compounds which may optionally be reacted with primary monoalkylamines and/or aliphatic alcohols (cf. EP-A-0 154 177, EP-A-0 777 712), the reaction products of alkenyl-spirobislactones with amines (cf. EP-A-0 413 279 B1) and, according to EP-A-0 606 055 A2, reaction products of terpolymers based on α,β-unsaturated dicarboxylic anhydrides, α,β-unsaturated compounds and polyoxyalkylene ethers of lower unsaturated alcohols.

The mixing ratio between the inventive cold additives and oil-soluble polar nitrogen compounds as constituent III may vary depending upon the application. Such additive mixtures preferably contain, based on the active ingredients, 0.1 to 10 parts by weight, preferably 0.2 to 5 parts by weight, of at least one oil-soluble polar nitrogen compound (constituent III) per part by weight of the inventive additive combination of A) and B).

Other preferred further cold flow improvers are resins of phenol derivatives bearing alkyl radicals and aldehydes as constituent IV. In a preferred embodiment of the invention, they are phenol-formaldehyde resins which contain oligo- or polymers with a repeat structural unit of the formula

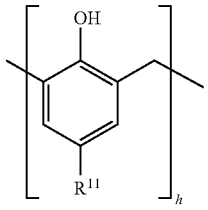

in which $R^{11}$ is $C_1$-$C_{200}$-alkyl or -alkenyl, O—$R^{10}$ or O—C(O)—$R^{10}$, $R^{10}$ is $C_1$-$C_{200}$-alkyl or -alkenyl and h is a number from 2 to 100. $R^{10}$ is preferably $C_1$-$C_{20}$-alkyl or -alkenyl and especially $C_4$-$C_{16}$-alkyl or -alkenyl, for example $C_6$-$C_{12}$-alkyl or -alkenyl. $R^{11}$ is more preferably $C_1$-$C_{20}$-alkyl or -alkenyl and especially $C_4$-$C_{16}$-alkyl or -alkenyl, for example $C_6$-$C_{12}$-alkyl or -alkenyl. h is preferably a number from 2 to 50 and especially a number from 3 to 25, for example a number from 5 to 15.

In a particularly preferred embodiment, constituent IV comprises those resins which derive from alkylphenols having one or two alkyl radicals in ortho and/or para positions to the OH group. Particularly preferred starting materials are alkylphenols which bear, on the aromatic, at least two hydrogen atoms capable of condensation with aldehydes, and especially monoalkylated phenols. The alkyl radical is more preferably in the para position to the phenolic OH group. The alkyl radicals (for constituent IV, this refers generally to hydrocarbon radicals as defined below) may be the same or different in the alkylphenol-aldehyde resins usable in the process according to the invention, they may be saturated or unsaturated and have 1-200, preferably 1-20, especially 4-16, for example 6-12, carbon atoms; they are preferably n-, iso- and tert-butyl, n- and isopentyl, n- and isohexyl, n- and isooctyl, n- and isononyl, n- and isodecyl, n- and isododecyl, tetradecyl, hexadecyl, octadecyl, tripropenyl, tetrapropenyl, poly(propenyl) and poly(isobutenyl) radicals. In a preferred embodiment, the alkylphenol resins are prepared by using mixtures of alkylphenols with different alkyl radicals. For example, resins based firstly on butylphenol and secondly on octyl-, nonyl- and/or dodecylphenol in a molar ratio of 1:10 to 10:1 have been found to be particularly useful.

Resins suitable as constituent IV may also contain or consist of structural units of further phenol analogs such as salicylic acid, hydroxybenzoic acid, aminophenol and derivatives thereof, such as esters, amides and salts.

Suitable aldehydes for the preparation of the resins are those having 1 to 12 carbon atoms and preferably having 1 to 4 carbon atoms, for example formaldehyde, acetaldehyde, propionaldehyde, butyraldehyde, 2-ethylhexanal, benzaldehyde, glyoxalic acid and their reactive equivalents such as paraformaldehyde and trioxane. Particular preference is given to formaldehyde in the form of paraformaldehyde and especially formalin.

The molecular weight of suitable resins, measured by means of gel permeation chromatography against poly(styrene) standards in THF, is preferably 500-25 000 g/mol, more preferably 800-10 000 g/mol and especially 1000-5000 g/mol, for example 1500-3000 g/mol. A prerequisite here is that the resins are oil-soluble at least in concentrations relevant to use of 0.001 to 1% by weight.

These resins are obtainable by known processes, for example by condensation of the corresponding phenol derivatives bearing alkyl radicals with formaldehyde.

Suitable further cold flow improvers are also comb polymers. Such comb polymers (constituent V) can be described, for example, by the formula

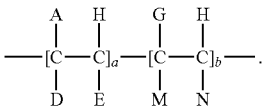

In this formula,

A is R', COOR', OCOR', R"—COOR', OR';

D is H, $CH_3$, A or R";

E is H, A;

G is H, R", R"—COOR', an aryl radical or a heterocyclic radical;

M is H, COOR", OCOR", OR", COOH;

N is H, R", COOR", OCOR, an aryl radical;

R' is a hydrocarbyl chain having 8 to 50 carbon atoms;

R" is a hydrocarbyl chain having 1 to 10 carbon atoms;

a is a number between 0.4 and 1.0; and b is a number between 0 and 0.6.

These are especially addition polymers obtainable by free-radical polymerization with C—C bond formation between the monomers. Suitable comb polymers are, for example, copolymers of ethylenically unsaturated dicarboxylic acids such as maleic acid or fumaric acid with other ethylenically unsaturated monomers such as olefins or vinyl esters, for example vinyl acetate. Particularly suitable olefins are α-olefins having 10 to 36 carbon atoms and especially having 12 to 24 carbon atoms, for example 1-decene, 1-dodecene, 1-tetradecene, 1-hexadecene, 1-octadecene and mixtures thereof. Also suitable as comonomers are longer-chain olefins based on oligomerized $C_2$-$C_6$-olefins, for example poly(isobutylene) with a high proportion of terminal double bonds. These copolymers are typically esterified to an extent of at least 50% with alcohols having 10 to 22 carbon atoms. Suitable alcohols include n-decan-1-ol, n-dodecan-1-ol, n-tetradecan-1-ol, n-hexadecan-1-ol, n-octadecan-1-ol, n-eicosan-1-ol and mixtures thereof. Particular preference is given to mixtures of n-tetradecan-1-ol and n-hexadecan-1-ol. Likewise suitable as comb polymers are poly(alkyl acrylates), poly(alkyl methacrylates) and poly(alkyl vinyl ethers) which derive from alcohols having 12 to 20 carbon atoms, and poly(vinyl esters) which derive from fatty acids having 12 to 20 carbon atoms. Likewise suitable as further cold flow improvers are homo- and copolymers of olefins having 2 to 30 carbon atoms (constituent VI). These may derive directly from monoethylenically unsaturated monomers or be prepared indirectly by hydrogenation of polymers which derive from polyunsaturated monomers such as isoprene or butadiene. Preferred copolymers contain, as well as ethylene, structural units which derive from α-olefins having 3 to 24 carbon atoms and have molecular weights of up to 120 000 g/mol. Preferred α-olefins are propylene, butene, isobutene, n-hexene, isohexene, n-octene, isooctene, n-decene, isodecene. The comonomer content of olefins is preferably between 15 and 50 mol %, more preferably between 20 and 35 mol % and especially between 30 and 45 mol %. These copolymers may also contain small amounts, for example up to 10 mol %, of further comonomers, for example nonterminal olefins or nonconjugated olefins. Particular preference is given to ethylene-propylene copolymers. Additionally preferred are copolymers of different olefins having 5 to 30 carbon atoms, for example poly(hexene-co-decene). The olefin homo- and copolymers can be prepared by known methods, for example by means of Ziegler or metallocene catalysts.

Further suitable olefin copolymers are block copolymers which contain blocks of olefinically unsaturated, aromatic monomers A and blocks of hydrogenated polyolefins B. Particularly suitable block copolymers are those of the $(AB)_C A$ and $(AB)_d$ structure where c is a number between 1 and 10 and d is a number between 2 and 10.

Likewise suitable as further cold flow improvers are oil-soluble polyoxyalkylene compounds (constituent VII), for example esters, ethers and ether/esters of polyols, which bear at least one alkyl radical having 12 to 30 carbon atoms. In a preferred embodiment, the oil-soluble polyoxyalkylene compounds possess at least 2, for example 3, 4 or 5, aliphatic hydrocarbon radicals. These radicals preferably independently possess 16 to 26 carbon atoms, for example 17 to 24 carbon atoms. These radicals of the oil-soluble polyoxyalkylene compounds are preferably linear. Additionally preferably, they are very substantially saturated, and are especially alkyl radicals. Esters are particularly preferred.

Polyols which are particularly suitable in accordance with the invention are polyethylene glycols, polypropylene glycols, polybutylene glycols and copolymers thereof with a molecular weight of approx. 100 to approx. 5000 g/mol, preferably 200 to 2000 g/mol. In a particularly preferred embodiment, the oil-soluble polyoxyalkylene compounds derive from polyols having 3 or more OH groups, preferably from polyols having 3 to about 50 OH groups, for example 4 to 10 OH groups, especially from neopentyl glycol, glycerol, trimethylolethane, trimethylolpropane, sorbitan, pentaerythritol, and the oligomers which are obtainable therefrom by condensation and have 2 to 10 monomer units, for example polyglycerol. Also suitable as polyols are higher polyols, for example sorbitol, sucrose, glucose, fructose and oligomers thereof, for example cyclodextrin, provided that the esterified or etherified alkoxylates thereof are oil-soluble at least in application-relevant amounts. Preferred polyoxyalkylene compounds thus have a branched polyoxyalkylene core to which a plurality of alkyl radicals which impart oil solubility are bonded.

The polyols are generally reacted with 3 to 70 mol of alkylene oxide, preferably 4 to 50 mol and especially 5 to 20 mol of alkylene oxide per hydroxyl group of the polyol. Preferred alkylene oxides are ethylene oxide, propylene oxide and/or butylene oxide. The alkoxylation is effected by known processes.

The fatty acids suitable for the esterification of the alkoxylated polyols have preferably 12 to 30 and especially 16 to 26 carbon atoms. Suitable fatty acids are, for example, lauric acid, tridecanoic acid, myristic acid, pentadecanoic acid, palmitic acid, margaric acid, stearic acid, isostearic acid, arachic acid and behenic acid, oleic acid and erucic acid, palmitoleic acid, myristoleic acid, ricinoleic acid, and fatty acid mixtures obtained from natural fats and oils. Preferred fatty acid mixtures contain more than 50 mol % of fatty acids having at least 20 carbon atoms. Preferably less than 50 mol % of the fatty acids used for esterification contain double bonds, particularly less than 10 mol %; they are especially very substantially saturated. The esterification may also proceed from reactive derivatives of the fatty acids, such as esters with lower alcohols (e.g. methyl or ethyl esters) or anhydrides.

In the context of the present invention, "very substantially saturated" is understood to mean an iodine number of the fatty acid used or of the fatty alcohol used of up to 5 g of I per 100 g of fatty acid or fatty alcohol.

Polyol and fatty acid are used for the esterification, based on the content of hydroxyl groups on the one hand and carboxyl groups on the other hand, in a ratio of 1.5:1 to 1:1.5, preferably in a ratio of 1.1:1 to 1:1.1 and especially in equimolar amounts. The acid number of the esters formed is generally less than 15 mg KOH/g, preferably less than 10 mg KOH/g, especially less than 5 mg KOH/g. The OH number of the esters is preferably less than 20 mg KOH/g and especially less than 10 mg KOH/g.

In a preferred embodiment, after the alkoxylation of the polyol, the terminal hydroxyl groups are converted to terminal carboxyl groups, for example by oxidation or by reaction with dicarboxylic acids. Reaction with fatty alcohols having 8 to 50, particularly 12 to 30 and especially 16 to 26 carbon atoms likewise affords inventive polyoxyalkylene esters. Preferred fatty alcohols or fatty alcohol mixtures contain more than 50 mol % of fatty alcohols having at least 20 carbon atoms. Preferably less than 50 mol % of the fatty alcohols used for esterification contain double bonds, particularly less than 10 mol %; they are especially very substantially saturated. Esters of alkoxylated fatty alcohols with fatty acids, which contain abovementioned proportions of poly(alkylene oxides) and whose fatty alcohol and fatty acid possess abovementioned alkyl chain lengths and degrees of saturation, are also suitable in accordance with the invention.

In addition, the above-described alkoxylated polyols can be converted to polyoxyalkylene compounds suitable in accordance with the invention by etherification with fatty alcohols having 8 to 50, particularly 12 to 30 and especially 16 to 26 carbon atoms. The fatty alcohols preferred for this purpose are linear and very substantially saturated. The etherification is preferably effected completely or at least very substantially completely. The etherification is performed by known processes.

Particularly preferred polyoxyalkylene compounds derive from polyols having 3, 4 and 5 OH groups, which bear about 5 to 10 mol of structural units derived from ethylene oxide per hydroxyl group of the polyol and are very substantially completely esterified with very substantially saturated $C_{17}$-$C_{24}$ fatty acids. Further particularly preferred polyoxyalkylene compounds are polyethylene glycols which have been esterified with very substantially saturated $C_{17}$-$C_{24}$ fatty acids and have molecular weights of about 350 to 1000 g/mol. Examples of particularly suitable polyoxyalkylene compounds are polyethylene glycols which have been esterified with stearic acid and especially behenic acid and have molecular weights between 350 and 800 g/mol; neopentyl glycol 14-ethylene oxide distearate (neopentyl glycol which has been alkoxylated with 14 mol of ethylene oxide and then esterified with 2 mol of stearic acid) and especially neopentyl glycol 14-ethylene oxide dibehenate; glycerol 20-ethylene oxide tristearate, glycerol 20-ethylene oxide dibehenate and especially glycerol 20-ethylene oxide tribehenate; trimethylolpropane 22-ethylene oxide tribehenate; sorbitan 25-ethylene oxide tristearate, sorbitan 25-ethylene oxide tetrastearate, sorbitan 25-ethylene oxide tribehenate and especially sorbitan 25-ethylene oxide tetrabehenate; pentaerythritol 30-ethylene oxide tribehenate, pentaerythritol 30-ethylene oxide tetrastearate and especially pentaerythritol 30-ethylene oxide tetrabehenate and pentaerythritol 20-ethylene oxide 10-propylene oxide tetrabehenate.

The mixing ratio between the inventive cold additives and the further cold flow improvers IV, V, VI and VII is generally in each case between 50:1 and 1:1, preferably between 10:1 and 2:1 by weight, based on the weights of (A+B):(IV, V, VI and VII).

The inventive cold additives improve especially the cold properties of those middle distillates which are obtained by distillation of crude oil and boil in the range from about 150 to 410° C. and especially in the range from about 170 to 380° C., or consist predominantly thereof, for example kerosene, jet fuel, diesel and heating oil. Middle distillates typically contain about 5 to 50% by weight, for example about 10 to 35% by weight, of n-paraffins, among which the longer-chain paraffins can crystallize out in the course of cooling and impair the flowability of the middle distillate. The inventive cold additives are particularly advantageous in middle distillates having a high content of cold-critical constituents with an n-alkyl chain having a carbon chain length of 16 or more carbon atoms. Examples of these include n-paraffins of fossil origin, but also n-paraffins which have been obtained by hydrogenation or cohydrogenation of animal and/or vegetable fats, and esters of saturated fatty acids with lower alcohols such as methanol or ethanol. Particularly in middle distillates having a content of more than 4% by weight and especially with 6 to 20% by weight, for example with 7 to 15% by weight, of these cold-critical constituents, the inventive cold additives have been found to be particularly useful. The inventive cold additives are additionally particularly advantageous in those oils which contain only a very low proportion of very long-chain n-paraffins having 28 or more carbon atoms, which function as natural nucleators for paraffin crystallization. The inventive cold additives have been found to be especially useful in oils which contain less than 1% by weight and especially less than 0.5% by weight, for example less than 0.3% by weight, of long-chain n-paraffins having 28 or more carbon atoms. Specific advantages are exhibited by the inventive cold additives especially in those oils which contain a high content of cold-critical constituents with an n-alkyl chain having 16 or more carbon atoms, and at the same time a very low proportion of very long-chain n-paraffins having 28 or more carbon atoms. The content of n-paraffins and any further cold-critical components, for example fatty acid methyl esters, is typically determined by means of gas chromatography. The inventive compositions are additionally particularly advantageous in middle distillates with a low final boiling point, i.e. in those middle distillates which have 90% distillation points below 360° C., especially 350° C. and in special cases below 340° C., and additionally in those middle distillates which have boiling ranges between 20 and 90% distillation volume of less than 120° C. and especially of less than 110° C. The middle distillates may also contain minor amounts, for example up to 40% by volume, preferably 1 to 20% by volume, especially 2 to 15%, for example 3 to 10% by volume, of the oils of animal and/or vegetable origin described in detail below, for example fatty acid methyl esters. The middle distillates preferably do not contain any residues from the distillation of mineral oils, for example residues from atmospheric distillation and/or vacuum distillation.

The inventive cold additives are likewise suitable for improving the cold properties of fuels based on renewable raw materials (biofuels). Biofuels are understood to mean oils which are obtained from animal material and preferably from vegetable material or both, and derivatives thereof, which can be used as a fuel and especially as a diesel or heating oil. They are especially triglycerides of fatty acids having 10 to 24 carbon atoms, and also the fatty acid esters of lower alcohols, such as methanol or ethanol, obtainable from them by transesterification.

Examples of suitable biofuels are rapeseed oil, coriander oil, soybean oil, cottonseed oil, sunflower oil, castor oil, olive oil, groundnut oil, corn oil, almond oil, palm kernel oil, coconut oil, mustard seed oil, bovine tallow, bone oil, fish oils and used cooking oils. Further examples include oils which derive from wheat, jute, sesame, shea tree nut, arachis oil and linseed oil. The fatty acid alkyl esters also known as biodiesel can be derived from these oils by processes known in the prior art. Rapeseed oil, which is a mixture of fatty acids esterified with glycerol, is preferred, since it is obtainable in large amounts and is obtainable in a simple manner by extractive pressing of rapeseed. Preference is further given to the likewise widespread oils of sunflowers, palms and soya, and mixtures thereof with rapeseed oil.

Particularly suitable biofuels are lower alkyl esters of fatty acids. Useful examples here are commercial mixtures of the ethyl esters, propyl esters, butyl esters and especially methyl esters of fatty acids having 14 to 22 carbon atoms, for example of lauric acid, myristic acid, palmitic acid, palmitoleic acid, stearic acid, oleic acid, elaidic acid, petroselic acid, ricinoleic acid, eleostearic acid, linoleic acid, linolenic acid, eicosanoic acid, gadoleic acid, docosanoic acid or erucic acid. Preferred esters have an iodine number of 50 to 150 and especially of 90 to 125. Mixtures with particularly advantageous properties are those which contain mainly, i.e. to an extent of at least 50% by weight, methyl esters of fatty acids having 16 to 22 carbon atoms and 1, 2 or 3 double bonds. The preferred lower alkyl esters of fatty acids are the methyl esters of oleic acid, linoleic acid, linolenic acid and erucic acid.

The inventive cold additives can be used alone or else together with other coadditives, for example with other pour point depressants or dewaxing assistants, with detergents, antioxidants, cetane number improvers, dehazers, demulsifiers, dispersants, antifoams, dyes, corrosion inhibitors, lubricity additives, sludge inhibitors, odorants and/or additives for lowering the cloud point.

The advantages of the inventive cold additives and the process which utilizes them lie in a distinct improvement in intrinsic flowability under cold conditions compared to corresponding prior art additive combinations, with a simultaneous improvement in efficacy. For instance, these cold additives, given the same active ingredient content, can also be used at lower temperatures than the prior art additives, without needing to be heated. Alternatively, given the same temperature, more highly concentrated additives can be used, and so the expenditure for transport and storage is reduced. In addition, the inventive cold additives surprisingly exhibit improved efficacy in the improvement of the cold flow properties of middle distillates. This is all the more unexpected in that the side chain density of the inventive comb polymers B) is much lower than in the case of the prior art comb polymers additionally esterified with fatty acids (DE-A-1 920 849, DE-A-2 451 047). The filterability of the fuel oils treated with the inventive cold additives is surprisingly also impaired to a much lesser extent than in the case of additization with prior art additives under the same conditions.

EXAMPLES

Polyester A)

The α-olefins used were commercially available mixtures of 1-alkenes with the specified compositions. The acid numbers were determined by titration of an aliquot of the reaction mixture with alcoholic tetra-n-butylammonium hydroxide solution in xylene/isopropanol. The hydroxyl numbers were determined, after reaction of the free OH groups of the polymers with isocyanate, by means of $^1$H NMR spectroscopy by quantitative determination of the urethane formed. The values reported are based on the solvent-free polymers. The molecular weights were determined by means of lipophilic gel permeation chromatography in THF against poly(ethylene glycol) standards and detection by means of an RI detector.

A1) Copolymer of equimolar proportions of $C_{20/24}$-alkenylsuccinic anhydride (prepared by thermal condensation of maleic anhydride with technical $C_{20/24}$-olefin containing, as main constituents, 43% $C_{20}$-, 35% $C_{22}$- and 17% $C_{24}$-olefin, with 90% α-olefins and 7.5% linear internal olefins) and ethylene glycol. The reactants were heated to 150° C. as a 50% solution in Shellsol®AB (relatively high-boiling aromatic solvent mixture) while stirring until the acid number remained constant. The water which formed was distilled off. The acid number of the polymer thus prepared was 10.0 mg KOH/g, the hydroxyl number 6 mg KOH/g and the weight-average molecular weight 8300 g/mol.

A2) Copolymer prepared in analogy to Example A1) of equimolar proportions of $C_{26/28}$-alkenylsuccinic anhydride (prepared by thermal condensation of maleic anhydride with technical $C_{26-28}$-olefin containing, as main constituents, 57% $C_{26}$-, 39% $C_{28}$— and 2.5% $C_{30+}$-olefin, with 85% α-olefins, 4% linear internal olefins and 9% branched olefins) and ethylene glycol. The acid number of the polymer was 12.7 mg KOH/g, the hydroxyl number 5 mg KOH/g and the weight-average molecular weight 5800 g/mol.

A3) Copolymer prepared in analogy to Example A1) from equimolar proportions of $C_{30+}$-alkenylsuccinic anhydride (prepared by thermal condensation of maleic anhydride with technical $C_{30+}$-olefin containing, as main constituents, 9% olefin in the $C_{24}$-$C_{28}$ range and 90% with carbon chain lengths of at least $C_{30}$, with 82% α-olefins, 3% linear internal olefins and 14% branched olefins) and ethylene glycol. The acid number of the polymer was 11.6 mg KOH/g, the hydroxyl number 11 mg KOH/g and the weight-average molecular weight 7400 g/mol.

A4) Copolymer prepared in analogy to Example A1) from equimolar proportions of $C_{20/24}$-alkenylsuccinic anhydride (prepared by thermal condensation of maleic anhydride with technical $C_{20/24}$-olefin containing, as main constituents, 43% $C_{20}$-, 35% $C_{22}$- and 17% $C_{24}$-olefin, with 90% α-olefins and 7.5% linear internal olefins) and diethylene glycol. The acid number of the polymer was 9.4 mg KOH/g, the hydroxyl number 10 mg KOH/g and the weight-average molecular weight 9400 g/mol.

A5) Copolymer prepared in analogy to Example A1) from 1 mol of $C_{20/24}$-alkenylsuccinic anhydride (prepared by thermal condensation of maleic anhydride with technical $C_{20/24}$-olefin containing, as main constituents, 43% $C_{20}$-, 35% $C_{22}$- and 17% $C_{24}$-olefin, with 90% α-olefins and 7.5% linear internal olefins), 0.95 mol of ethylene glycol and 0.05 mol of behenyl alcohol. The acid number of the polymer was 5.3 mg KOH/g, the hydroxyl number 3 mg KOH/g and the weight-average molecular weight 6900 g/mol.

A6) Copolymer of equal molar proportions of $C_{20/24}$-alkenylsuccinic anhydride according to Example A1, glycerol and behenic acid in analogy to polymer G of DE-A-24 51 047. The acid number of the polymer was 15 mg KOH/g, the hydroxyl number 6 mg KOH/g and the weight-average molecular weight 8300 g/mol (comparative example).

A7) Addition copolymer of equimolar proportions of maleic anhydride and $C_{20/24}$-olefin, esterified with 2 molar equivalents of behenyl alcohol. The acid number of the polymer was 9 mg KOH/g, the hydroxyl number 11 mg KOH/g and the weight-average molecular weight 7900 g/mol (comparative example)

Ethylene Copolymers B)

B1) Terpolymer of ethylene, 13.5 mol % of vinyl acetate and 1.5 mol % of vinyl neononanoate, having a melt viscosity measured at 140° C. of 95 mPas.

B2) Terpolymer of ethylene, 12 mol % of vinyl acetate and 5 mol % of propene, with a melt viscosity measured at 140° C. of 200 mPas.

B3) Copolymer of ethylene and 13 mol % of vinyl acetate, with a melt viscosity measured at 140° C. of 125 mPas.

B4) Terpolymer of ethylene, 12.5 mol % of vinyl acetate and 4 mol % of 4-methyl-1-pentene, with a melt viscosity measured at 140° C. of 170 mPas.

The melt viscosity of the ethylene copolymers B) was determined by means of a rotary viscometer at a temperature of 140° C. Before the measurement, all volatile components were removed from the ethylene copolymer B) at 150° C./100 mbar.

Solvents C)

C1) Solvesso® 150: high-boiling aromatic mixture (approx. 98% aromatics, 0.7% naphthalene, boiling range 175-205° C., flashpoint 65° C.)

C2) White spirit: mixture of mainly paraffinic and naphthenic hydrocarbons in the $C_{10}$ to $C_{16}$ range (aromatics content 16%, boiling range 182-212° C., flashpoint 63° C.)

To determine the cold properties of the cold additives, the pour points thereof were determined to DIN ISO 3016. A low pour point indicates good flowability and hence good manageability under cold conditions. The percentages reported for the additives relate to the proportions by weight of the additive constituents used. The proportions by weight specified for the polymers relate to solvent-free active ingredients. Any solvent components present in the polymers as a result of the synthesis are shown as solvent C).

TABLE 1

Determination of the pour points

| Additive | Polyester A | Polymer B | Solvent C | Pour point |
|---|---|---|---|---|
| 1 | 6.5% A1 | 58.5% B1 | 35% C1 | +3 |
| 2 | 6.5% A2 | 58.5% B1 | 35% C1 | +9 |
| 3 | 6.5% A4 | 58.5% B1 | 35% C1 | 0 |
| 4 | 6.5% A5 | 58.5% B1 | 35% C1 | −3 |
| 5 (comp.) | 6.5% A6 | 58.5% B1 | 35% C1 | +30 |
| 6 (comp.) | 6.5% A7 | 58.5% B1 | 35% C1 | +30 |
| 7 | 3.5% A1 | 31.5% B2 | 65% C1 | −21 |
| 8 | 3.5% A2 | 31.5% B2 | 65% C1 | −18 |
| 9 | 3.5% A3 | 31.5% B2 | 65% C1 | −15 |
| 10 | 3.5% A4 | 31.5% B2 | 65% C1 | −24 |
| 11 | 3.5% A5 | 31.5% B2 | 65% C1 | −30 |
| 12 (comp.) | 3.5% A6 | 31.5% B2 | 65% C1 | −12 |
| 13 (comp.) | 3.5% A7 | 31.5% B2 | 65% C1 | −9 |
| 14 | 2.0% A1 | 38.0% B3 | 60% C2 | −3 |
| 15 | 2.0% A2 | 38.0% B3 | 60% C2 | +3 |
| 16 | 2.0% A3 | 38.0% B3 | 60% C2 | +9 |
| 17 | 2.0% A4 | 38.0% B3 | 60% C2 | −3 |
| 18 | 2.0% A5 | 38.0% B3 | 60% C2 | −6 |

TABLE 1-continued

Determination of the pour points

| Additive | Polyester A | Polymer B | Solvent C | Pour point |
|---|---|---|---|---|
| 19 (comp.) | 2.0% A6 | 38.0% B3 | 60% C2 | +12 |
| 20 (comp.) | 2.0% A7 | 38.0% B3 | 60% C2 | +12 |
| 21 | 3.5% A1 | 46.5% B4 | 50% C1 | −21 |
| 22 | 3.5% A2 | 46.5% B4 | 50% C1 | −15 |
| 23 | 3.5% A4 | 46.5% B4 | 50% C1 | −18 |
| 24 | 3.5% A5 | 46.5% B4 | 50% C1 | −21 |
| 25 (comp.) | 3.5% A6 | 46.5% B4 | 50% C1 | 3 |
| 26 (comp.) | 3.5% A7 | 46.5% B4 | 50% C1 | 0 |

The efficacy of the additives was studied by means of the lowering of the CFPP value to DIN EN 116 in a low-sulfur middle distillate having the characteristics shown in Table 2. The components with n-alkyl radical $\geq C_{16}$ and the n-paraffins $\geq C_{28}$ were determined by means of gas chromatography.

TABLE 2

Characterization of the test oils

| | | Test oil 1 | Test oil 2 | Test oil 3 |
|---|---|---|---|---|
| Initial boiling point | [° C.] | 179 | 171 | 173 |
| Final boiling point | [° C.] | 348 | 355 | 331 |
| Boiling range (20-90)% | [° C.] | 94 | 93 | 89 |
| Density | [g/cm$^3$] | 0.8437 | 0.8555 | 0.8409 |
| Cloud point | [° C.] | −15.6 | −11.7 | −22.0 |
| CFPP | [° C.] | −15 | −12 | −22 |
| Sulfur content | [ppm] | <10 | <10 | <10 |
| Components with n-alkyl radical $\geq C_{16}$ | [% by wt.] | 9.8 | 11.1 | 8.3 |
| n-Paraffins $\geq C_{28}$ | [% by wt.] | 0.11 | 0.04 | 0.01 |

TABLE 3

CFPP efficacy in test oil 1

| Example | Additive (according to Tab. 1) | CFPP [° C.] 200 ppm | CFPP [° C.] 300 ppm |
|---|---|---|---|
| 1 (comp.) | none | −15 | −15 |
| 2 (comp.) | B1 (65% in C1) | −17 | −20 |
| 3 | 1 | −28 | −33 |
| 4 | 2 | −26 | −32 |
| 5 | 3 | −29 | −33 |
| 6 | 4 | −29 | −31 |
| 7 (comp.) | 5 | −25 | −29 |
| 8 (comp.) | 6 | −21 | −27 |

TABLE 4

CFPP efficacy in test oil 1

| Example | Additive (according to Tab. 1) | CFPP [° C.] 350 ppm | CFPP [° C.] 500 ppm |
|---|---|---|---|
| 9 (comp.) | none | −15 | −15 |
| 10 (comp.) | B2 (35% in C1) | −16 | −18 |
| 11 | 7 | −29 | −35 |
| 12 | 8 | −31 | −33 |
| 13 | 9 | −30 | −33 |
| 14 | 10 | −30 | −32 |
| 15 | 11 | −32 | −34 |
| 16 (comp.) | 12 | −28 | −30 |
| 17 (comp.) | 13 | −25 | −28 |

TABLE 5

| CFPP efficacy in test oil 2 | | | |
|---|---|---|---|
| | Additive | CFPP [° C.] | |
| Example | (according to Tab. 1) | 100 ppm | 150 ppm |
| 18 (comp.) | none | −12 | −12 |
| 19 (comp.) | B3 (60% in C2) | −16 | −22 |
| 20 | 14 | −28 | −30 |
| 21 | 15 | −28 | −32 |
| 22 | 16 | −29 | −32 |
| 23 | 17 | −27 | −30 |
| 24 | 18 | −29 | −32 |
| 25 (comp.) | 19 | −20 | −24 |
| 26 (comp.) | 20 | −18 | −23 |

For comparison of the solubility of the cold additives, 200 ml of test oil 3 (Table 2) were admixed with 1000 ppm of an additive according to Table 1 at the temperature specified in Table 6 in a 250 ml measuring cylinder. The additives were added by means of a direct displacement pipette in order to be able to manage the high viscosity of the comparative additives in particular. After rotating the measuring cylinder by 180° ten times, a visual examination was made for undissolved additive constituents.

TABLE 6

| Solubility of the additives in test oil 3 | | | | |
|---|---|---|---|---|
| Example | Additive | $T_{additive}$ [° C.] | $T_{oil}$ [° C.] | Appearance |
| 27 | 1 | 6 | −3 | homogeneous, clear |
| 28 | 3 | 6 | −3 | homogeneous, clear |
| 29 (comp.) | 5 (comp.) | 6 | −3 | additive substantially undissolved |
| 30 (comp.) | 6 (comp.) | 6 | −3 | additive substantially undissolved |
| 31 | 7 | −12 | −20 | homogeneous, clear |
| 32 | 8 | −12 | −20 | homogeneous, clear |
| 33 | 9 | −12 | −20 | homogeneous, clear |
| 34 (comp.) | 12 (comp.) | −12 | −20 | contains many flakes |
| 35 (comp.) | 13 (comp.) | −12 | −20 | contains many flakes |

The invention claimed is:

1. A cold additive for middle distillates comprising

A) at least one polyester of the formula (A1

(A1

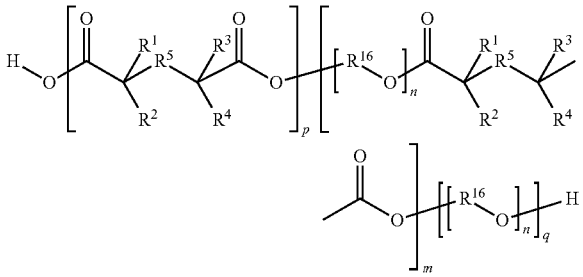

in which one of the $R^1$ to $R^4$ radicals is a linear $C_{16}$-$C_{40}$-alkyl or -alkenyl radical and the rest of the $R^1$ to $R^4$ radicals are each independently hydrogen or an alkyl radical having 1 to 3 carbon atoms, $R^5$ is a C—C bond or an alkylene radical having 1 to 6 carbon atoms, $R^{16}$ is a hydrocarbyl group having 2 to 10 carbon atoms, n is a number from 2 to 100, m is a number from 5 to 150, p is 0 or 1, and q is 0 or 1, B) at least one copolymer of ethylene and at least one ethylenically unsaturated ester, wherein the copolymer has a melt viscosity measured at 140° C. of not more than 5000 mPas and C) at least one organic solvent.

2. The cold additive as claimed in claim 1, in which $R^1$ is a $C_{16}$- to $C_{40}$-alkyl or -alkenyl radical, $R^2$, $R^3$ and $R^4$ are each hydrogen and $R^5$ is a single bond.

3. The cold additive as claimed in claim 1, in which $R^{16}$ is an ethylene group.

4. The cold additive as claimed in claim 1, in which $R^{16}$ is a $C_2$- to $C_4$-alkylene group and n is a number from 2 to 100.

5. The cold additive as claimed in claim 1, wherein copolymer B) is a copolymer of ethylene and 8 to 21 mol % of at least one olefinically unsaturated compound selected from the group consisting of vinyl esters, acrylic esters and methacrylic esters.

6. The cold additive as claimed in claim 1, wherein the solvent C) is selected from the group consisting of aliphatic hydrocarbons having 9 to 20 carbon atoms and aromatic hydrocarbons having 7 to 20 carbon atoms.

7. The cold additive as claimed in claim 1, wherein the solvent C) additionally comprises a solubilizer which contains 4 to 24 carbon atoms and is selected from the group consisting of alcohols, organic acids, ethers of organic acids, esters of organic acids and mixtures thereof.

8. The cold additive as claimed in claim 1, comprising 0.1 to 50% by weight of A), 1.5 to 73.5% by weight of B) and 25 to 95% by weight of C).

9. The cold additive as claimed in claim 1, further comprising at least one further cold flow improver, selected from the group consisting of III) oil-soluble polar nitrogen compounds, IV) resins of phenol derivatives bearing alkyl radicals with aldehydes, V) comb polymers of the formula

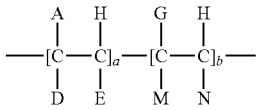

in which

A is R', COOR', OCOR', R"—COOR', OR';

D is H, $CH_3$, A or R";

E is H, A;

G is H, R", R"—COOR', an aryl radical or a heterocyclic radical;

M is H, COOR", OCOR", OR", COOH;

N is H, R", COOR", OCOR, an aryl radical;

R' is a hydrocarbyl chain having 8 to 50 carbon atoms;

R" is a hydrocarbyl chain having 1 to 10 carbon atoms;

a is a number between 0.4 and 1.0; and b is a number between 0 and 0.6,

VI) homo- and copolymers of olefins having 2 to 30 carbon atoms, and

VII) esters, ethers and ester/ethers of alkoxylated polyols, which have at least one alkyl radical having 12 to 30 carbon atoms.

10. A process for improving the cold flow properties of fuel oils, comprising the step of adding a cold additive as claimed in claim 1 to a middle distillate.

11. A fuel oil comprising a middle distillate and at least one cold additive as claimed in claim 1.

12. The fuel oil as claimed in claim 11, in which the middle distillate has more than 4% by weight of constituents with an n-alkyl chain having 16 or more carbon atoms, wherein the constituents are selected from the group consisting of n-paraffins of fossil origin, n-paraffins prepared by hxydrogenation or cohydrogenation of animal and/or vegetable fats, and esters of saturated fatty acids with lower alcohols.

13. The fuel oil as claimed in claim 11, in which the middle distillate has a proportion of long-chain n-paraffins having 28 or more carbon atoms of less than 1% by weight.

* * * * *